US006209680B1

(12) United States Patent
Perdue

(10) Patent No.: US 6,209,680 B1
(45) Date of Patent: Apr. 3, 2001

(54) ACOUSTIC DIFFUSER PANELS AND WALL ASSEMBLY COMPRISED THEREOF

(76) Inventor: Jay Perdue, 4210 W. Hester Rd., Amarillo, TX (US) 79124

( * ) Notice: Subject to any disclaimer, the term of this patent is extended or adjusted under 35 U.S.C. 154(b) by 0 days.

(21) Appl. No.: 09/546,398

(22) Filed: Apr. 10, 2000

(51) Int. Cl.[7] ..... E04B 1/82
(52) U.S. Cl. ..... 181/295; 181/286; 181/210
(58) Field of Search ..... 181/295, 286, 181/210, 285, 288, 293

(56) References Cited

U.S. PATENT DOCUMENTS

| | | | | |
|---|---|---|---|---|
| 3,483,944 | | 12/1969 | Handy, Jr. . | |
| 3,498,405 | | 3/1970 | Charpentier . | |
| 4,356,880 | | 11/1982 | Downs . | |
| 4,362,222 | | 12/1982 | Hellstrom . | |
| 4,605,093 | | 8/1986 | Karlen . | |
| 5,141,073 | | 8/1992 | Pelonis . | |
| 5,424,497 | | 6/1995 | Dias et al. . | |
| 5,641,950 | | 6/1997 | Kotter . | |
| 5,644,872 | | 7/1997 | Perdue . | |
| 5,962,107 | * | 10/1999 | Lowery et al. | 428/131 |
| 5,965,852 | * | 10/1999 | Roschke | 181/210 |
| 5,969,301 | * | 10/1999 | Cullum, Je. et al. | 181/286 |
| 6,016,887 | * | 1/2000 | Underhill et al. | 181/210 |
| 6,024,190 | * | 2/2000 | Ritzema | 181/286 |
| 6,035,965 | * | 3/2000 | Fujiwara | 181/293 |
| 6,082,489 | * | 7/2000 | Iwao et al. | 181/286 |

* cited by examiner

*Primary Examiner*—David Martin
*Assistant Examiner*—Kim Lockett
(74) *Attorney, Agent, or Firm*—Norman Rainer

(57) ABSTRACT

A panel which diffuses sound incident thereupon is provided having a rectangular perimeter and wedge-shaped configuration wherein the front surface of the panel is angularly disposed with respect to its flat rear surface. The front surface contains a series of parallel elongated depressions. A multitude of such panels are employed along with sound reflecting and sound absorbing panels to produce a wall-mounted assemblage of sound-interactive panels capable of desirably modifying the subjectively perceived quality of sound in a room or auditorium.

17 Claims, 4 Drawing Sheets

ACOUSTIC DIFFUSER PANELS AND WALL ASSEMBLY COMPRISED THEREOF

BACKGROUND OF THE INVENTION

1. Field of the Invention

This invention concerns the acoustic treatment of sound in large indoor areas, and more particularly relates to panels for the formation of wall mounted assemblies capable of efficient interaction with incident sound.

2. Description of the Prior Art

It is often sought to diminish the noise level in indoor rooms, auditoriums, gymnasiums, restaurants, hallways, cafeterias, manufacturing plants and other indoor areas. In theaters where music is performed, the quality of the music heard by the audience is enhanced when the acoustic characteristics of the theater minimizes echoes, reverberations and ambient noise.

Various types of sound-absorbing rigid panel products have been employed as ceiling tiles, and various rigid and soft wall coverings have been disclosed for sound absorption. In most cases the sound-absorbing panels constitute a uniform array in their wall or ceiling installations. It has been found however, that panels intended to alter the characteristics of sound in an indoor enclosure are of greatest effectiveness when the nature and placement of the panels is custom-designed to accommodate the characteristics of the area being serviced and the type of sound encountered.

In situations where a customized sound-interactive system is being installed, it is often necessary to employ considerable trial and testing to optimize the system in terms of the types of panels employed, and their placement and interrelationships. An array of acoustic wall panels may, for example be comprised of an interactive assembly of different panels whose individual specific functions are to reflect, diffuse or absorb sound. With suitable trial and testing, the most suitable combination and arrangement may be found for the various panels.

Flat rectangular sound absorbing panels suitable for wall mounting in an abutting assemblage are disclosed in U.S. Pat. No. 5,644,872 and elsewhere. Sound absorbing wall panels having a trapezoidal wedge shape are disclosed in U.S. Pat. No. 5,141,073. Panels having a plurality of projections for the purpose of minimizing reflection of sound are disclosed U.S. Pat. No. 3,498,405. Pyramidal panels for enhancing the reflection of sound in an audience area are disclosed in U.S. Pat. No. 4,356,880.

Although diffuser panels are important components of a wall-mounted array of interactive panels for achieving efficient alteration of sound, diffuser panels of the prior art are either inadequate in their performance or are incompatible with adjacent panels providing other sound modifying characteristics.

It is accordingly an object of the present invention to provide an improved wall-mountable sound diffusing panel.

It is another object of this invention to provide an assemblage of wall-mounted panels of varied functionality with respect to interaction with sound, said assembly comprising diffusing panels as in the foregoing object.

It is another object of the present invention to provide a sound diffusing panel of the aforesaid nature of lightweight construction amen ale to low cost manufacture.

These objects and other objects and advantages of the invention will be apparent from the following description.

SUMMARY OF THE INVENTION

The above and other beneficial objects and advantages are accomplished in accordance with the present invention by a self supporting sound-diffuser panel having:

a) a flat rear surface, b) opposed parallel first and second long side surfaces and opposed parallel first and second short end surfaces, said side and end surfaces being forwardly directed from said rear surface in orthogonal relationship therewith to constitute a rectangular perimeter and terminating in straight forward edges that lie in a front plane inclined with respect to said rear surface, thereby causing said panel to have a wedge shape characterized in having a plane of symmetry that bisects said side surfaces in orthogonal relationship to said rear surface, c) a front surface comprised of:

1) a series of parallel flat lanes extending between said end surfaces and disposed within said inclined front plane, and 2) elongated recesses disposed between said lanes and formed by the deformation of appropriate portions of said front surface toward said rear surface, and d) an interior compartment bounded by said front, rear, side and end surfaces.

The present invention further contemplates a sound absorbing wall assemblage comprised of a multitude of the aforesaid rectangular diffuser panels arranged in substantially abutting relationship with sound reflecting and sound absorbing panels of rectangular perimeter and shaped similar to the wedge shape of said diffuser panels.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
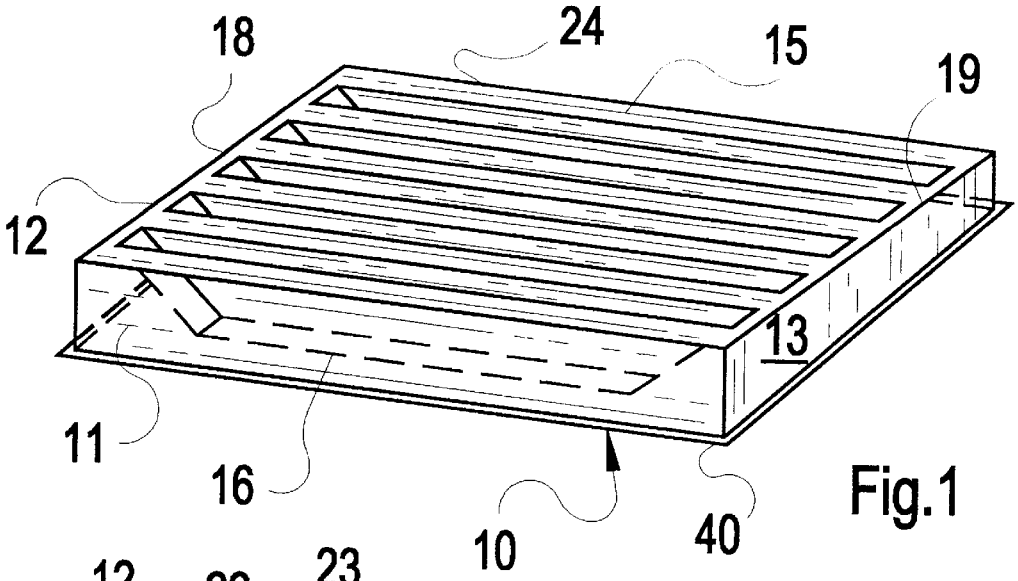
FIG. 1 is a perspective front view of an embodiment of the diffuser panel of the present invention.
Figure 2:
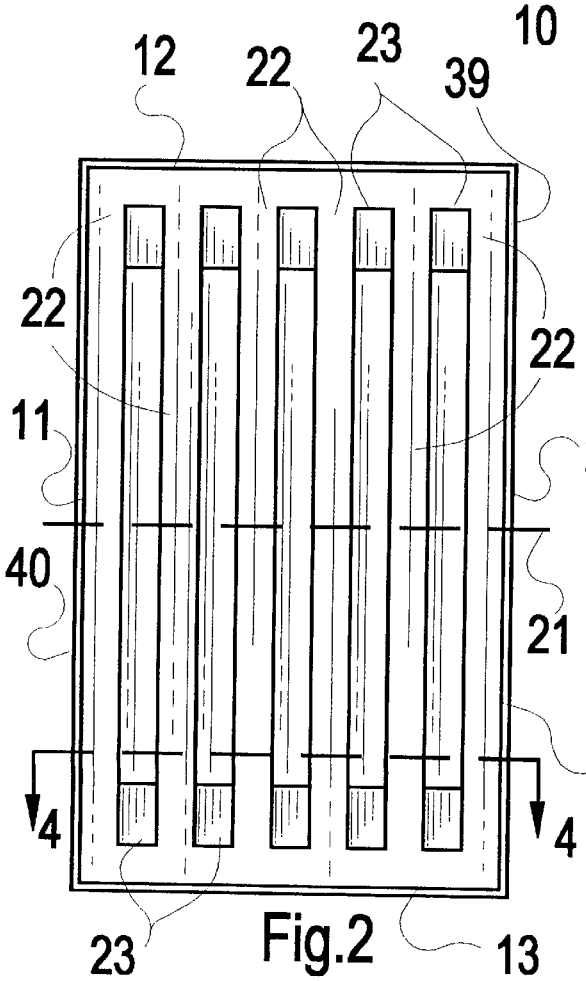
FIG. 2 is a front view of the panel of FIG. 1.
Figure 3:
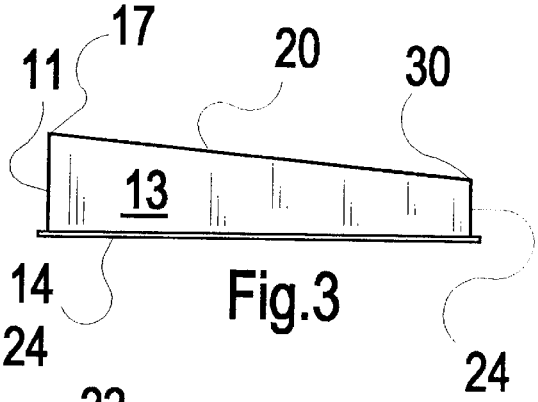
FIG. 3 is an end view of the panel of FIG. 1.
Figure 4:
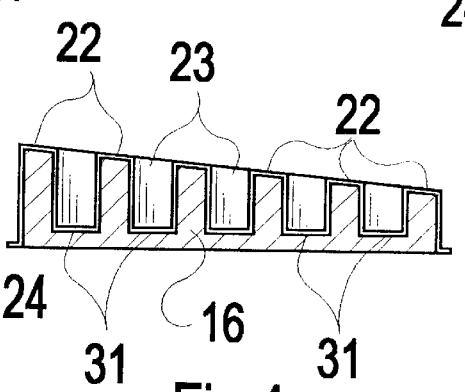
FIG. 4 is a sectional view taken in the direction of the arrows upon the line 4—4 of FIG. 2.
Figure 5:
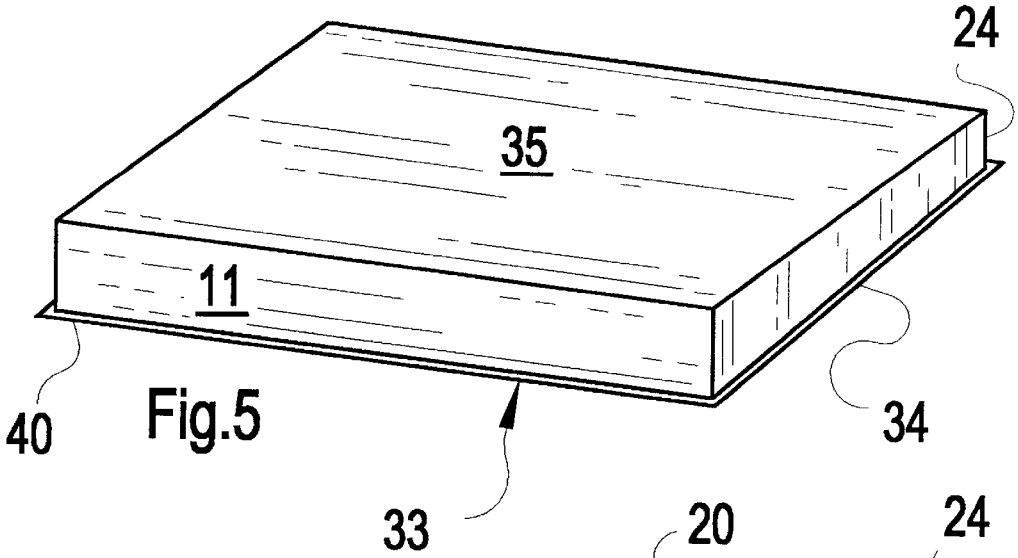
FIG. 5 is a perspective front view of a sound reflector panel useful in producing the wall assemblage of the present invention.
Figure 6:
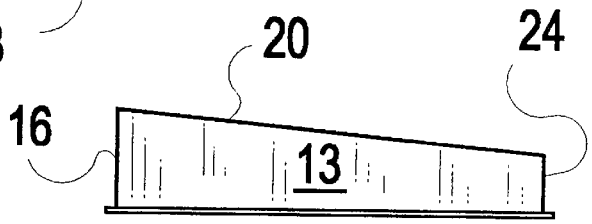
FIG. 6 is an end view of the panel of FIG. 5.
Figure 7:
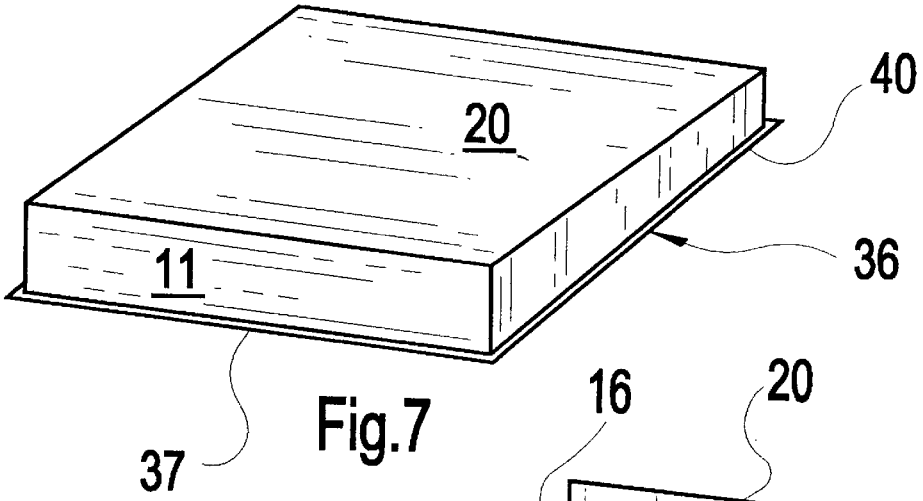
FIG. 7 is a perspective front view of a sound absorber panel useful in producing the wall assemblage of the present invention.
Figure 8:
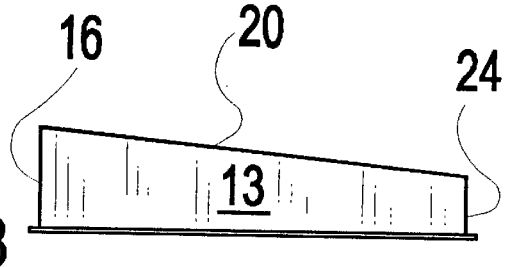
FIG. 8 is an end view of the panel of FIG. 7.
Figure 9:
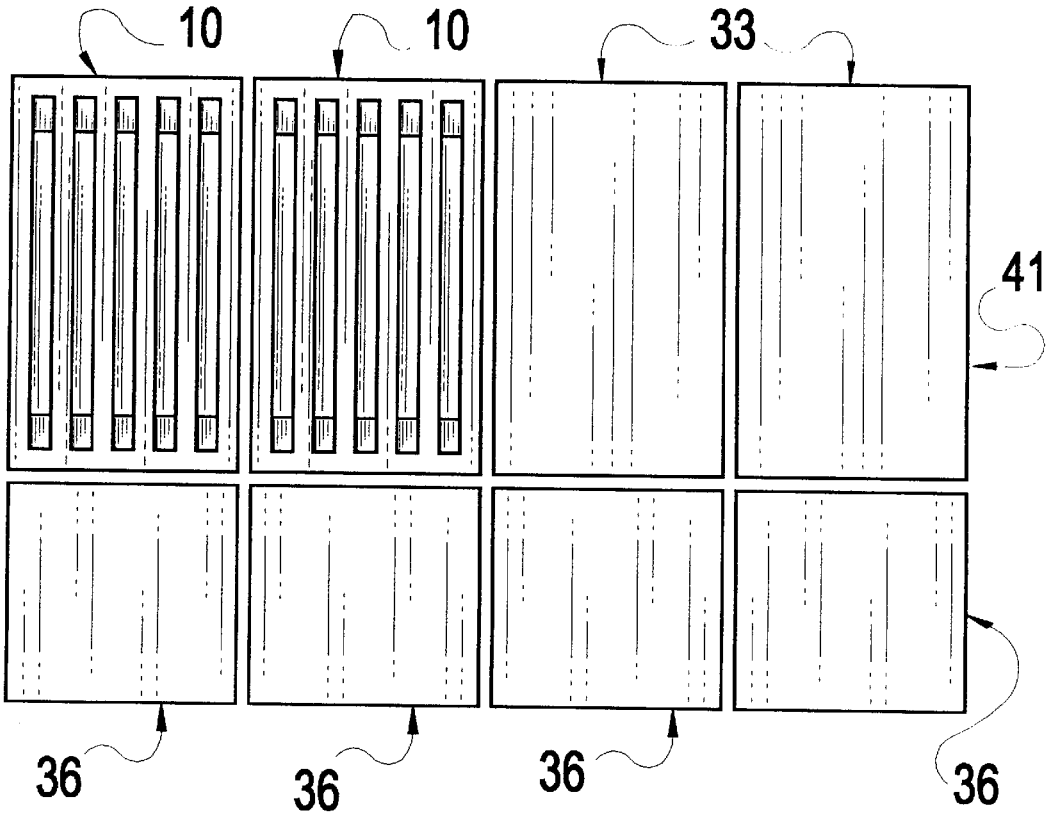
FIG. 9 is a front view of the wall assemblage of panels of the present invention.
Figure 10:
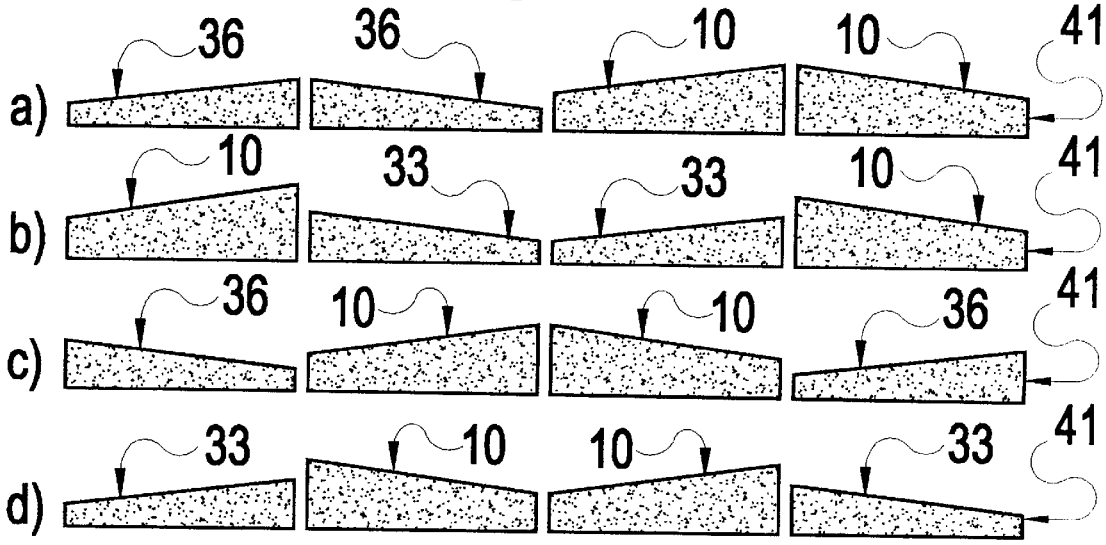
FIGS. 10 a, b, c and d are horizontal sectional views representative of the assemblage of FIG. 9.

Referring now to FIGS. 1–3, an embodiment of the sound diffuser panel 10 of this invention is shown comprised of flat rectangular rear surface 14, opposed parallel first and second long side surfaces 11 and 24, respectively, opposed parallel first and second short end surfaces 12 and 13, respectively, and front surface 15. Said side and end surfaces are forwardly directed from said rear surface, defining a rectangular perimeter 39 of the panel. The several aforesaid surfaces are preferably comprised of plastic sheet material having a thickness between about 1/16" and ¼", and are bonded along their lines of contact, thereby producing a box-like integrated structure having an air-filled hollow interior compartment 16. Suitable plastic sheet material includes thermoformable plastics such as polyethylene, polypropylene, polyvinyl chloride, and ABS (acrylonitrile, butadiene, styrene terpolymer).

Side surfaces 11 and 24 extend substantially orthogonally between said front and rear surfaces in joinder therewith. In the exemplified embodiment, the height of the side surfaces, measured between said front and rear surfaces, remains uniform throughout their length between said opposed end surfaces. However, first side surface 11 is shown to be higher than second side surface 24. The height of said end surfaces diminishes in a linearly tapered manner in going from first side surface 11 to second side surface 24. For example, in the embodiment of FIG. 1, both end surfaces are congruent and may have a height of 6 inches adjacent first side surface 11 and may linearly taper down to a height of 3.5 inches at second side surface 24. In other equivalent embodiments, said end surfaces may taper from 3.5 inches to 1.0 inch in their extent between said first to second side surfaces. Accordingly, the taper ratio, namely the largest height of the end surface divided by its shortest height, may range from about 1.5 to 3.5. The thickness of the panel may be considered to be the height of said side or end surfaces, and accordingly will vary throughout the panel because of the wedge shape.

The length of the panel, namely the distance of separation between end surfaces 12 and 13 may be about four feet. The width of the panel, as measured between said side surfaces, may be about two feet.

Side surfaces 11 and 24 terminate in straight forward edges 17 and 30, respectively, and end surfaces 12 and 13 terminate in straight forward edges 18 and 19, respectively.

Said straight forward edges 17, 30, 18 and 19 lie in a front plane 20 which is inclined with respect to rear surface 14, thereby causing said panel to have a wedge shape. Said wedge shape, in the exemplified embodiment, is further characterized in having a plane of symmetry 21 that bisects said side surfaces in orthogonal relationship to said rear surface. The expression "bisects" is intended to denote a locus line centered between said end surfaces and in parallel relationship therewith.

Front surface 15 is disposed upon said straight forward edges 17, 30, 18 and 19 and is comprised of parallel flat lanes 22 elongated between said end surfaces and disposed within said inclined front plane 20. Elongated recesses 23 of substantially rectangular profile are disposed between said lanes, and are formed by the deformation of appropriate portions of said front surface toward said rear surface. Each recess extends to a straight bottom surface 31 which is substantially parallel to lanes 22. The depth of each recess, measured between lane 22 and bottom surface 31 is between about ½" and 6". The width of each recess is between ½" and 1½". The ratio of the depth to width of the recess is preferably between 0.2 and 5.7. The width of the lanes 22 is preferably between about 1½"and 3". In a typical panel of two foot width, there will be about six lanes 22 and five intervening recesses 23.

The effectiveness of the panel of the present invention in diffusing sound may be measured in terms of two factors generally employed in characterizing the effectiveness of surfaces in diffusing sound, namely: a) angular reflectivity of an orthogonally impacting beam of sound, and b) the retardation of reflected sound within 25 milliseconds.

In conducting the angular reflectivity measurement (a), a speaker is caused to direct a narrow beam of sound of a specific frequency and intensity in a first experiment to impact orthogonally onto a ¼" steel plate. During such sound exposure, a directional microphone is caused to traverse the plate in a radius centered upon said site of impact.

The microphone measures sound intensity in decibels (db) reflected at various angles with respect to the site of sound impingement onto the plate from the speaker. The measured values of reflected sound intensity are then graphically plotted. In a second experiment, the sound diffusing undergoing testing is subjected to the same treatment, and the measured reflected sound intensity values are plotted on the same graph as for the case of the first, steel plate experiment. Such graphical presentation of data is shown in FIG. 11.

Figure 11:
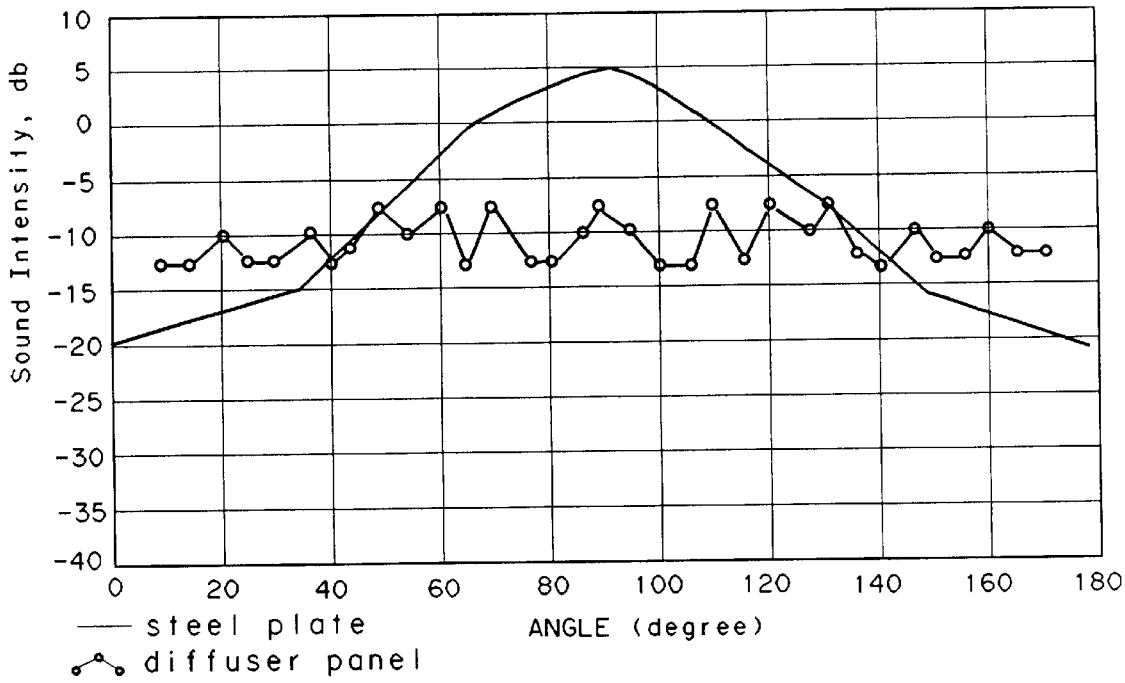
FIG. 11 is a graphical depiction of angular reflectivity of sound provided by the diffuser panel of this invention.

Referring now to FIG. 11, the measured reflected sound intensity in decibel units is represented by the vertical axis. The horizontal axis of the graph represents the corresponding angle with respect to the plane of the steel plate or test surface at which the measurement of reflected sound intensity was made. The graph of FIG. 11 shows as a bell-shaped curve reflected sound intensities measured on the steel plate using a sound frequency of 12 $KH_z$. Theoretically perfect diffusion of reflected sound intensity is represented by the straight line at −10 db. The values of reflected sound intensity measured on a diffuser panel of the present invention is shown in the saw-tooth plot centered on said −10 db line.

The departure from the ideality of line −10 db can be measured by the total amount of area above and below the −10 db line, said area being in units of db degrees integrated throughout the extent of the graph. For the control, steel plate, such integration provides a value of 1760 db degrees. For the diffuser panel of this invention, said integrated value is 300 db degrees. Accordingly, the diffuser panel of this invention is seen to provide 83% better diffusion of sound than a steel plate reference standard. When measured in this manner, the diffuser panel of the present invention will generally provide between 50% and 85% greater diffusion of sound than a steel plate reference standard. The practical effect of the diffuser panel is that high frequency sounds, which are more directional than low frequency sounds, are scattered throughout an auditorium so that the reflected sound can more evenly reach many listeners.

Figure 12:
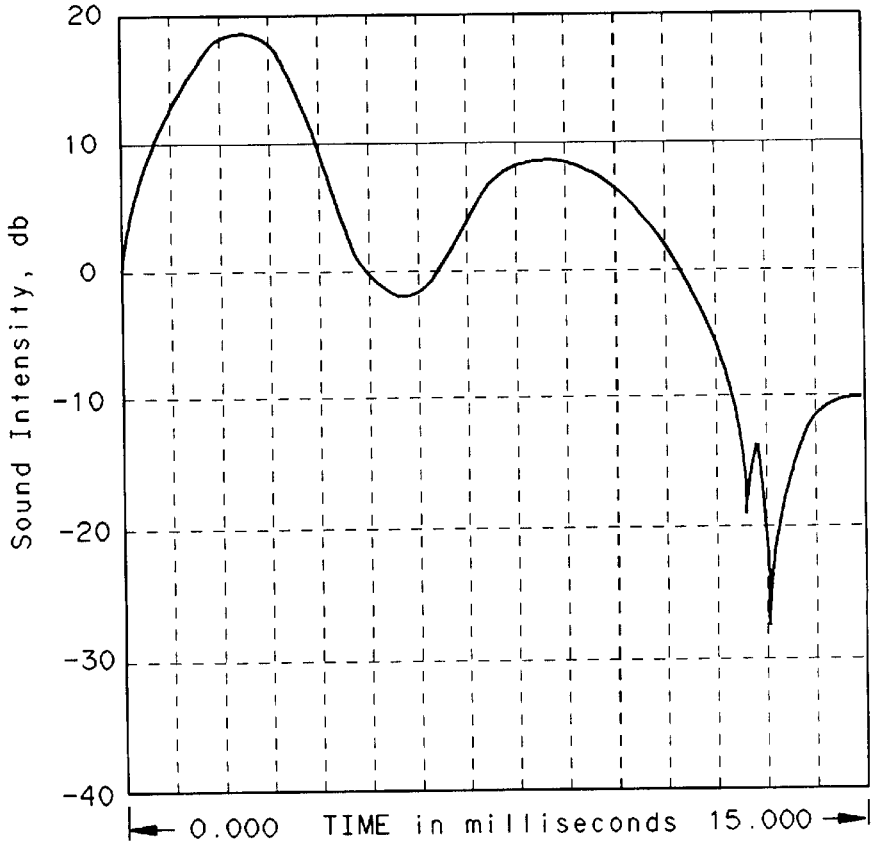
FIG. 12 is a graphical depiction of retardation of reflected sound provided by the diffuser panel of this invention.

In conducting measurement b on retardation of reflected sound, an initial burst of sound of a specific frequency and intensity is directed upon a surface being tested. The intensity of reflected sound is then continuously measured for about 25 milliseconds. The data is then graphically plotted, as in FIG. 12. The graphical data of FIG. 12 plots sound intensity on the vertical axis and time on the horizontal axis. The double-peaked curve in the graph of FIG. 12 represents data for the same diffuser panel as tested for the data of FIG. 11, now tested for sound retardation using a sound frequency of 12 $KH_z$.

The first peak in the curve of FIG. 12 represents sound which travels directly from the speaker to the microphone. The apogee of said first peak occurs in about 2 milliseconds, and the band width or duration of the peak is about 4 milliseconds. The second peak in the curve represents sound reflected from the diffuser panel. The apogee of said second peak occurs about six milliseconds later than the apogee of the first peak, and its band width or duration is about six milliseconds. By way of comparison, when the same test is conducted upon a steel plate, representing an ideal non-diffusing surface, the duration of the second peak is exactly the same as the duration of the first peak. Accordingly, the diffuser panel of the present invention is seen to achieve greater retardation of reflected sound than a reference steel plate. Such effect enhances the fullness of the subjectively perceived sound. Depending upon the frequency of the sound employed in said test, the diffuser panel of the present invention can achieve up to 1.9 times greater duration of reflected sound than the steel plate, as represented by the width of said second peak.

A flange 40 surrounds perimeter 39. Said flange, having a uniform width of ½ to 1 inch, is an extension of rear surface 14, and serves to facilitate the mounting of the panel onto a flat wall or ceiling surface.

In constructing the acoustic wall assemblage of the present invention, panels are selected from amongst diffuser panels of this invention of varied thickness, and rectangular reflector and absorber panels having wedge shapes similar to the shape of the diffuser panel.

The exemplified reflector panels 33 have a rectangular perimeter 34 and have a wedge-shaped configuration similar to that of the diffuser panel of this invention. The primary difference, however, is that, whereas the front surface of the diffuser panel has a series of parallel elongated recesses 23, the front surface 35 of the reflector panels is substantially flat and devoid of recesses. This causes the reflector panel to have sound reflectivity characteristics similar to those of the aforesaid steel plate standard.

The absorber panels 36 have a rectangular perimeter 37 wherein the width of the panel is the same as the widths of the diffuser and reflector panels. The length of the absorber panel may however be half, equal to, or double the length of the diffuser panel. The absorber panels contain a fabric layer covering which enhances sound absorption, and further contain a specialized rock wool material as delineated in U.S. Pat. No. 5,644,872. The absorber panel, when tested for sound absorption by way of ASTM Test C423-90a, provides a noise reduction coefficient above 1.20.

In the wall assemblage, the various sound-interactive panels are placed such that the flat rear surface is against a supporting wall structure, and the inclined front surface is directed toward the interior of the room or auditorium. The panels may be secured to the wall by releasible means such as hook and loop fastener material, or may be more durably secured by way of conventional adhesives or fasteners. The diffuser panels are preferably oriented in said assemblage such that recesses 23 are vertically oriented. With suitable rearrangement of panels and retesting for sound absorption, echo free sound is obtained which may be optimized with respect to subjectively perceived characteristics.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A sound-diffuser panel having:

a) a flat rear surface, b) opposed parallel first and second long side surfaces and opposed parallel first and second short end surfaces, said side and end surfaces being forwardly directed from said rear surface to constitute a rectangular perimeter and terminating in straight forward edges that lie in a front plane inclined with respect to said rear surface, thereby causing said panel to have a wedge shape characterized in having a plane of symmetry that bisects said side surfaces in orthogonal relationship to said rear surface, c) a front surface comprised of:

1) a series of parallel flat lanes extending between said end surfaces and disposed within said inclined front plane, and 2) elongated recesses disposed between said lanes, and d) an interior compartment bounded by said front, rear, side and end surfaces, e) said several surfaces being comprised of plastic sheet material having a thickness between 1/16 and ¼ inch.

2. The sound diffuser panel of claim 1 wherein said elongated recesses are formed by the deformation of appropriate portions of said front surface toward said rear surface.

3. The sound diffuser panel of claim 1 wherein said interior compartment is hollow.

4. The sound diffuser panel of claim 1 where said interior compartment is air-filled.

5. The sound diffuser panel of claim 1 wherein said first and second long side surfaces are of unequal height.

6. The sound diffuser panel of claim 5 wherein said first and second short end surfaces are of identical size and shape.

7. The sound diffuser panel of claim 6 wherein said short end surfaces have a height which tapers in their extent between said long side surfaces.

8. The sound diffuser panel of claim 7 wherein said taper has a taper ratio between 1.5 and 3.5.

9. An assemblage of sound-interactive panels mounted upon a supporting wall, said assemblage having a multitude of the sound diffuser panel of claim 1 and further comprising:

a) a multitude of sound absorbing panels having a flat rear surface and rectangular perimeter, and b) a multitude of sound reflecting panels having a flat rear surface and rectangular perimeter.

10. The assemblage of claim 9 wherein said sound-interactive panels are mounted upon said supporting wall by way of said flat rear surfaces.

11. The assemblage of claim 9 wherein said sound absorber panels and sound reflecting panels have a wedge-shaped configuration similar to that of said diffuser panel.

12. The assemblage of claim 9 wherein said sound-interactive panels are positioned in abutting relationship.

13. The assemblage of claim 12 wherein said diffuser panels are positioned such that said recesses are vertically oriented.

14. A sound-diffuser panel having:

a) a flat rear surface, b) opposed parallel first and second long side surfaces and opposed parallel first and second short end surfaces, said side and end surfaces being forwardly directed from said rear surface to constitute a rectangular perimeter and terminating in straight forward edges that lie in a front plane inclined with respect to said rear surface, thereby causing said panel to have a wedge shape characterized in having a plane of symmetry that bisects said side surfaces in orthogonal relationship to said rear surface, c) a front surface comprised of:

1) a series of parallel flat lanes extending between said end surfaces and disposed within said inclined front plane, and 2) elongated recesses disposed between said lanes, and d) an interior compartment bounded by said front, rear, side and end surfaces, e) said recesses having a substantially rectangular profile.

15. The sound diffuser panel of claim 14 wherein each recess has a straight bottom surface which is substantially parallel to said lanes.

16. A sound-diffuser panel having:

a) a flat rear surface, b) opposed parallel first and second long side surfaces and opposed parallel first and second short end surfaces, said side and end surfaces being forwardly directed from said rear surface to constitute a rectangular perimeter and terminating in straight forward edges that lie in a front plane inclined with respect to said rear surface, thereby causing said panel to have a wedge shape characterized in having a plane of symmetry that bisects said side surfaces in orthogonal relationship to said rear surface, c) a front surface comprised of:

1) a series of parallel flat lanes extending between said end surfaces and disposed within said inclined front plane, and 2) elongated recesses disposed between said lanes, and d) an interior compartment bounded by said front, rear, side and end surfaces, e) said sound-diffuser panel providing between 50% and 85% greater diffusion of sound than a steel plate reference standard.

17. A sound-diffuser panel having:

a) a flat rear surface, b) opposed parallel first and second long side surfaces and opposed parallel first and second short end surfaces, said side and end surfaces being forwardly directed from said rear surface to constitute a rectangular perimeter and terminating in straight forward edges that lie in a front plane inclined with respect to said rear surface, thereby causing said panel to have a wedge shape characterized in having a plane of symmetry that bisects said side surfaces in orthogonal relationship to said rear surface, c) a front surface comprised of:

1) a series of parallel flat lanes extending between said end surfaces and disposed within said inclined front plane, and 2) elongated recesses disposed between said lanes, d) an interior compartment bounded by said front, rear, side and end surfaces, and e) flange which surrounds said perimeter.

* * * * *